US012024265B2

(12) United States Patent
Araki et al.

(10) Patent No.: US 12,024,265 B2
(45) Date of Patent: Jul. 2, 2024

(54) PERSONAL WATERCRAFT

(71) Applicant: KAWASAKI MOTORS, LTD., Akashi (JP)

(72) Inventors: Toshio Araki, Kakogawa (JP); Yu Shibuta, Kobe (JP); Azusa Onohata, Akashi (JP)

(73) Assignee: KAWASAKI MOTORS, LTD., Akashi (JP)

( * ) Notice: Subject to any disclaimer, the term of this patent is extended or adjusted under 35 U.S.C. 154(b) by 754 days.

(21) Appl. No.: 17/154,948

(22) Filed: Jan. 21, 2021

(65) Prior Publication Data

US 2022/0227460 A1 Jul. 21, 2022

(51) Int. Cl.

| | |
|---|---|
| ***B63B 13/00*** | (2006.01) |
| ***B63B 3/48*** | (2006.01) |
| ***B63B 34/10*** | (2020.01) |

(52) U.S. Cl.
CPC ..... *B63B 13/00* (2013.01); *B63B 3/48* (2013.01); *B63B 34/10* (2020.02)

(58) Field of Classification Search
CPC ..... B63B 13/00; B63B 34/10; B63B 3/48
See application file for complete search history.

(56) References Cited

U.S. PATENT DOCUMENTS 5,850,803 A * 12/1998 Jones ..... B63B 34/10 362/477
2009/0107377 A1* 4/2009 Duquette ..... B63B 34/10 114/55.57
2009/0107380 A1* 4/2009 Duquette ..... B63B 34/10 188/297
2009/0139437 A1* 6/2009 Simard ..... B63B 34/10 114/55.51
2009/0158982 A1* 6/2009 Ross ..... B63B 25/002 114/55.57
2009/0194010 A1* 8/2009 Spade ..... B63B 34/10 114/55.57

FOREIGN PATENT DOCUMENTS

JP 200279988 A 3/2002
JP 2002079988 A * 3/2002 ..... B63B 35/731
JP 2011088524 A * 5/2011 ..... B63B 35/731

* cited by examiner

*Primary Examiner* — S. Joseph Morano
*Assistant Examiner* — Jovon E Hayes
(74) *Attorney, Agent, or Firm* — Alleman Hall & Tuttle LLP

(57) ABSTRACT

A personal watercraft includes a watercraft body including: a center elongated protrusion located at a center of the watercraft body in a left-right direction, extending in a front-rear direction, and having an upwardly convex cross-sectional shape; a drainage channel outward of and adjacent to the center elongated protrusion in the left-right direction, lying along the center elongated protrusion in the front-rear direction, extending rearward and outward in the left-right direction, and having a downwardly convex cross-sectional shape; and an outside elongated protrusion outward of and adjacent to the drainage channel in the left-right direction, lying along the drainage channel in the front-rear direction, having an upwardly convex cross-sectional shape, and facing the drainage channel from outside in the left-right direction.

17 Claims, 9 Drawing Sheets

PERSONAL WATERCRAFT

BACKGROUND OF THE INVENTION

Technical Field

The present disclosure relates to a personal watercraft maneuvered by a rider on a water surface.

Description of the Related Art

Japanese Laid-Open Patent Application Publication No. 2002-79988 discloses a personal watercraft including a deck having a streamlined front portion.

SUMMARY OF THE INVENTION

A personal watercraft according to an aspect of the present disclosure includes: a handle; and a watercraft body supporting the handle and including a front upper portion anterior to the handle, the watercraft body further including: a center elongated protrusion constituting a part of the front upper portion, the center elongated protrusion being located at a center of the watercraft body in a left-right direction, extending in a front-rear direction, and having an upwardly convex cross-sectional shape; a drainage channel constituting a part of the front upper portion, the drainage channel being outward of and adjacent to the center elongated protrusion in the left-right direction, lying along the center elongated protrusion in the front-rear direction, extending rearward and outward in the left-right direction, and having a downwardly convex cross-sectional shape; and an outside elongated protrusion outward of and adjacent to the drainage channel in the left-right direction, the outside elongated protrusion lying along the drainage channel in the front-rear direction, having an upwardly convex cross-sectional shape, and facing the drainage channel from outside in the left-right direction.

In the above configuration, since the watercraft body includes the drainage channel extending rearward and outward in the left-right direction, water impinging on the front of the watercraft body of the personal watercraft can be led into the drainage channel, directed outward in the left-right direction, and finally discharged outside. Thus, water impinging on the front of the watercraft body of the personal watercraft can be prevented from flowing toward the rider. This can reduce the amount of water splashing onto the rider and therefore the discomfort felt by the rider due to splashing water. Additionally, since the drainage channel has a cross-sectional shape convex downward and toward the center of the watercraft body in the left-right direction, water entering the drainage channel can be efficiently guided and discharged outside. Additionally, since the watercraft body further includes the outside elongated protrusion outward of and adjacent to the drainage channel in the left-right direction, water impinging obliquely on the front of the watercraft body and flowing toward the rider can be blocked by the outside elongated protrusion to reduce the amount of water splashing onto the rider.

A personal watercraft according to an aspect of the present disclosure includes: a handle; and a watercraft body supporting the handle and including a front upper portion anterior to the handle, the watercraft body further including a guide protruding from an upper edge of a drainage channel and extending along the upper edge, the drainage channel having a downwardly convex cross-sectional shape.

In the above configuration, since the watercraft body includes the guide, when, for example, water climbs over the upper edge of the drainage channel and flows toward the rider, the guide pushes down the flowing water and blocks the water from flowing out of the drainage channel, thereby preventing the water from splashing onto the rider. Thus, water can be prevented from reaching the rider beyond the drainage change. This can reduce the discomfort felt by the rider due to splashing water.

The above and further objects, features and advantages of the present disclosure will be more apparent from the following detailed description of preferred embodiments with reference to the accompanying drawings.

DETAILED DESCRIPTION OF THE EMBODIMENTS

Hereinafter, exemplary embodiments will be described with reference to the drawings. The up-down, left-right, and front-rear directions are defined herein as those based on the viewpoint of a rider (operator) of a personal watercraft who sits on a seat of the watercraft. The left-right direction and the front-rear direction are defined with respect to a horizontal plane in which the personal watercraft is located when moored at rest on a water surface.

Figure 1:
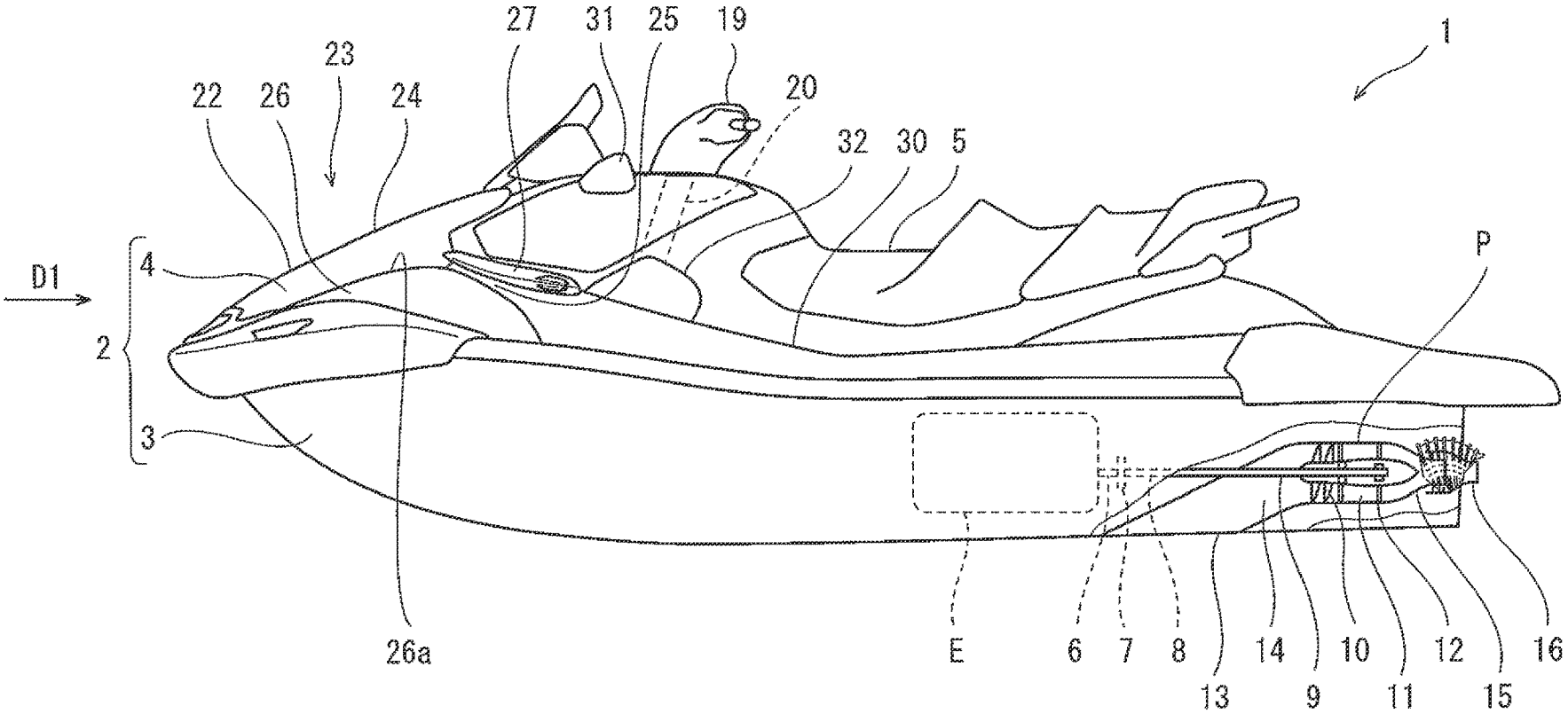
FIG. 1 is a side view of a personal watercraft according to an exemplary embodiment.

FIG. 1 is a partially cutaway side view of a personal watercraft 1 according to an exemplary embodiment. As shown in FIG. 1, the personal watercraft 1 includes a watercraft body 2, and the watercraft body 2 includes a hull 3 and a deck 4 covering the upper portion of the hull 3. The personal watercraft 1 of the present embodiment is a sitting-type watercraft having the watercraft body 2 equipped with a seat 5 on which the rider sits in a straddling position. The watercraft body 2 includes an internal space, in which an engine E is accommodated as a prime mover.

The engine E includes an output shaft 6 extending toward the rear of the watercraft body 2. The output shaft 6 has an output end connected to a propeller shaft 8 via a coupler 7. A water jet pump P is disposed in the rear of the hull 3 and located at the center in the left-right direction. The water jet pump P includes a pump shaft 9, to which the propeller shaft 8 is connected. Thus, the pump shaft 9 rotates in conjunction with rotation of the output shaft 6. An impeller 10 is mounted on the pump shaft 9, and a stator vane 11 is disposed behind the impeller 10. A tubular pump casing 12 is mounted around the impeller 10 to enclose the impeller 10.

A water inlet 13 opens at the bottom of the watercraft body 2. The water inlet 13 is in communication with the pump casing 12 through a water passage 14. To the pump casing 12 is connected a pump nozzle 15 disposed in the rear of the watercraft body 2. The pump nozzle 15 has a diameter that decreases from front to rear, and an ejection orifice opens at the rear end of the pump nozzle 15. To the ejection orifice of the pump nozzle 15 is connected a steering nozzle 16, which is swingable to the left and right.

In the personal watercraft 1, water drawn into the hull 3 through the water inlet 13 located at the bottom of the hull 3 is pressurized and accelerated by rotational power of the impeller 10 of the water jet pump P driven by the engine E. The flow of water is controlled by the stator vane 11 and ejected vigorously rearward through the ejection orifice of the pump nozzle 15 and the steering nozzle 16. Thus, the personal watercraft 1 obtains propulsion power using a reaction force produced by water ejected from the water jet pump P to the outside through the steering nozzle 16.

A handle 19 to be gripped by the rider for steering maneuver is disposed on a front portion of the deck 4. The handle 19 is fixedly connected to the steering shaft 20. In the present embodiment, the handle 19 is located anterior to the seat 5. The steering shaft 20 is pivotally supported by the watercraft body 2 with the aid of a bearing (not illustrated). Thus, the steering shaft 20 provides a connection between the handle 19 and the watercraft body 2. The steering shaft 20 extends downward from the handle 19. In the present embodiment, the steering shaft 20 is inclined in the front-rear direction with respect to the watercraft body 2 in such a manner that the upper end of the steering shaft 20 is posterior to the lower end of the steering shaft 20. The deck 4 is provided with an upwardly opening recess located anterior to the handle 19 and serving as a storage. The storage is a space for accommodating items. The watercraft body 2 includes a hatch cover 22 configured to close the upwardly opening recess of the deck 4 from above.

A steering cable (not shown) is attached to the vicinity of the lower end of the steering shaft 20. The steering cable is made of a flexible material and therefore bendable. The steering cable extends between the steering shaft 20 and the steering nozzle 16. Thus, the handle 19 is connected to the steering nozzle 16 via the steering shaft 20 and the steering cable. The steering cable transmits a tensile force induced by tilting operation of the handle 19 to the steering nozzle 16. As such, the steering nozzle 16 swings to the left and right in conjunction with tilting of the handle 19 to the left and right.

The handle 19 is equipped with an operation member (not illustrated). The rider can accelerate or decelerate the watercraft to a desired degree by operating the operation member. By rotating the handle 19 to the left or right, the rider can, as needed, change the direction in which the watercraft body 2 moves. Thus, the rider can control the behavior of the watercraft body 2 by operating the handle 19 and the operation member.

Figure 2:
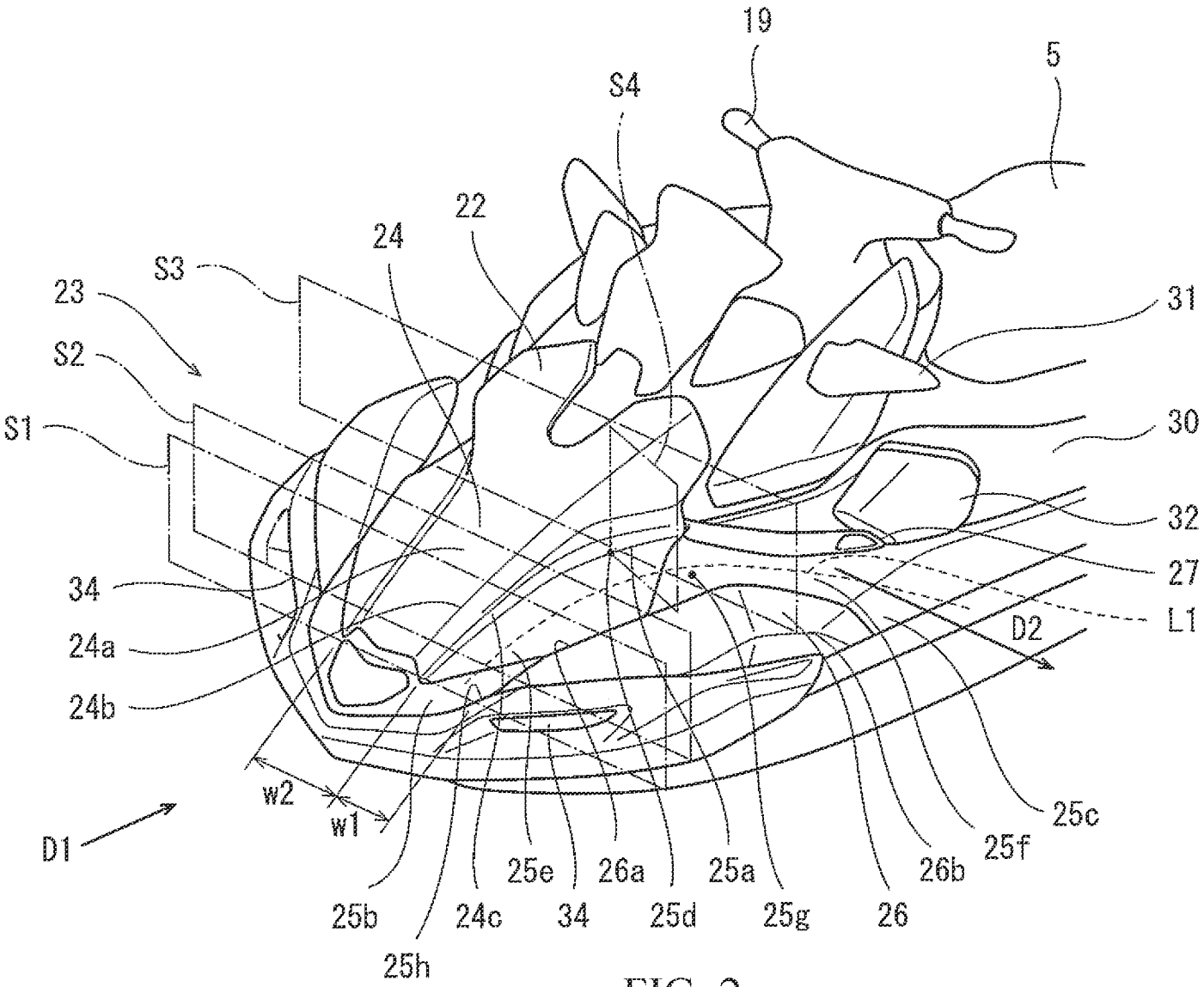
FIG. 2 is a perspective view of a front portion of the personal watercraft of FIG. 1.
Figure 3A:
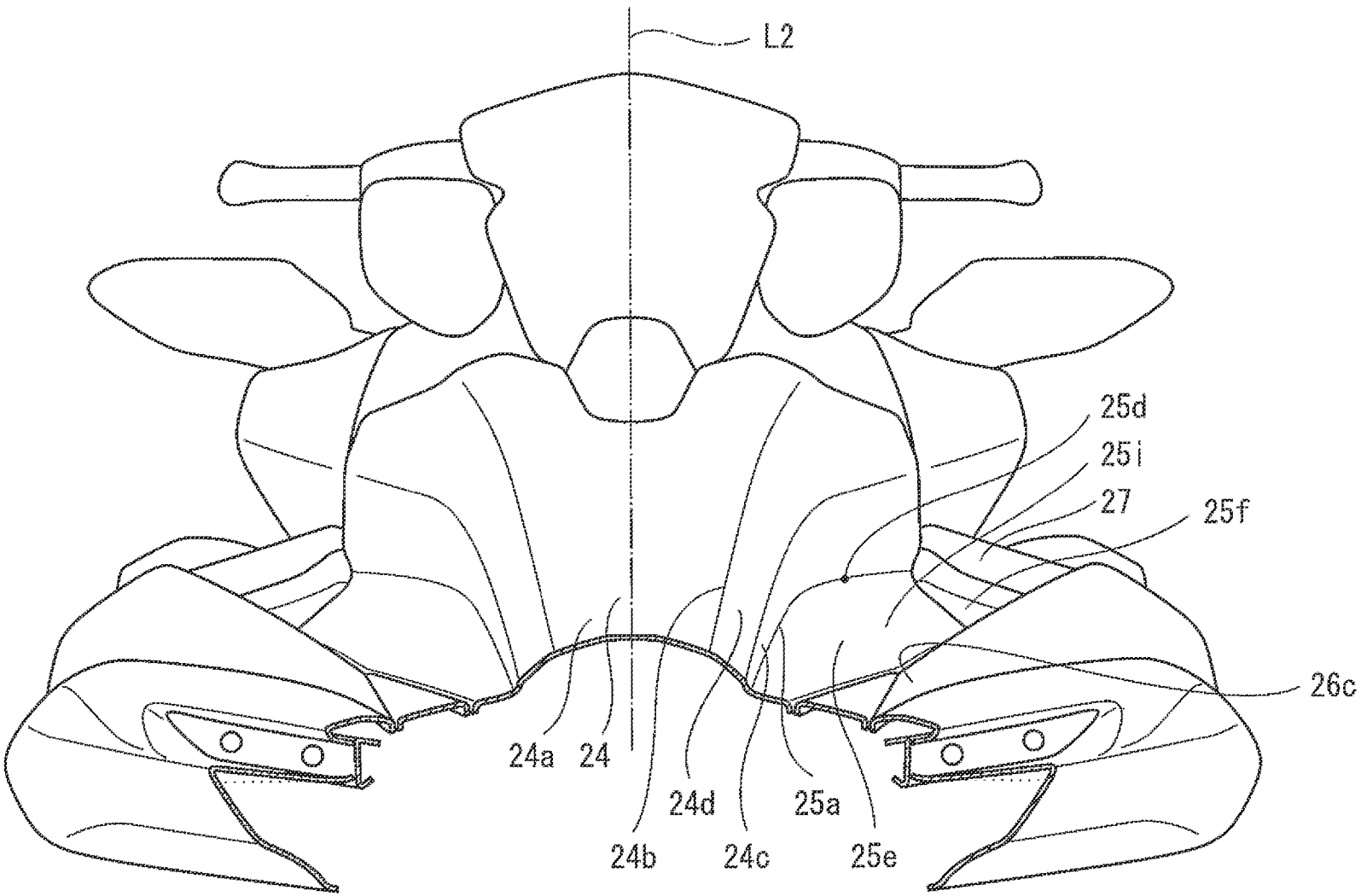
FIG. 3A is a cross-sectional view taken along the plane S1 of FIG. 2.
Figure 3B:
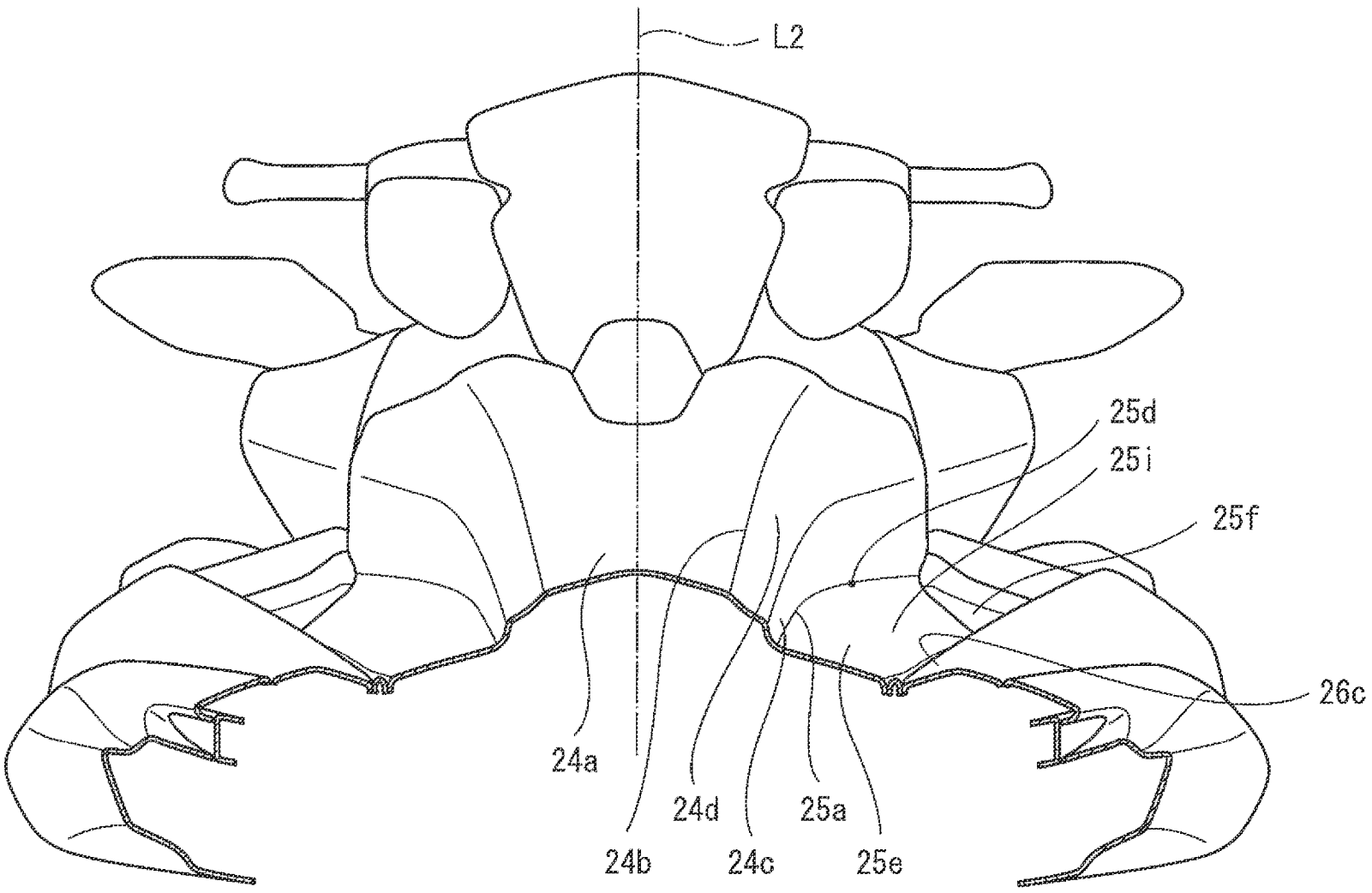
FIG. 3B is a cross-sectional view taken along the plane S2 of FIG. 2.
Figure 3C:
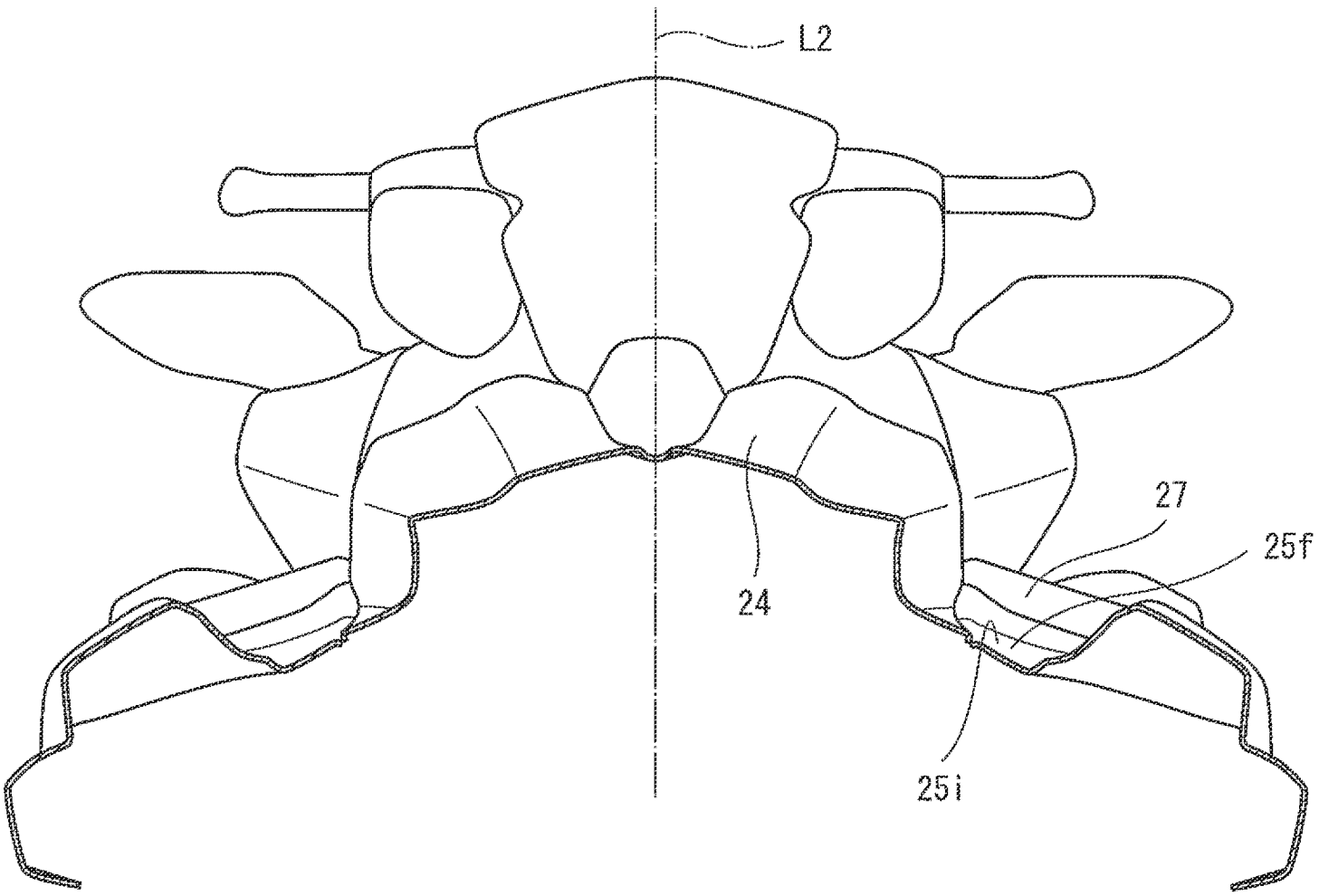
FIG. 3C is a cross-sectional view taken along the plane S3 of FIG. 2.
Figure 4:
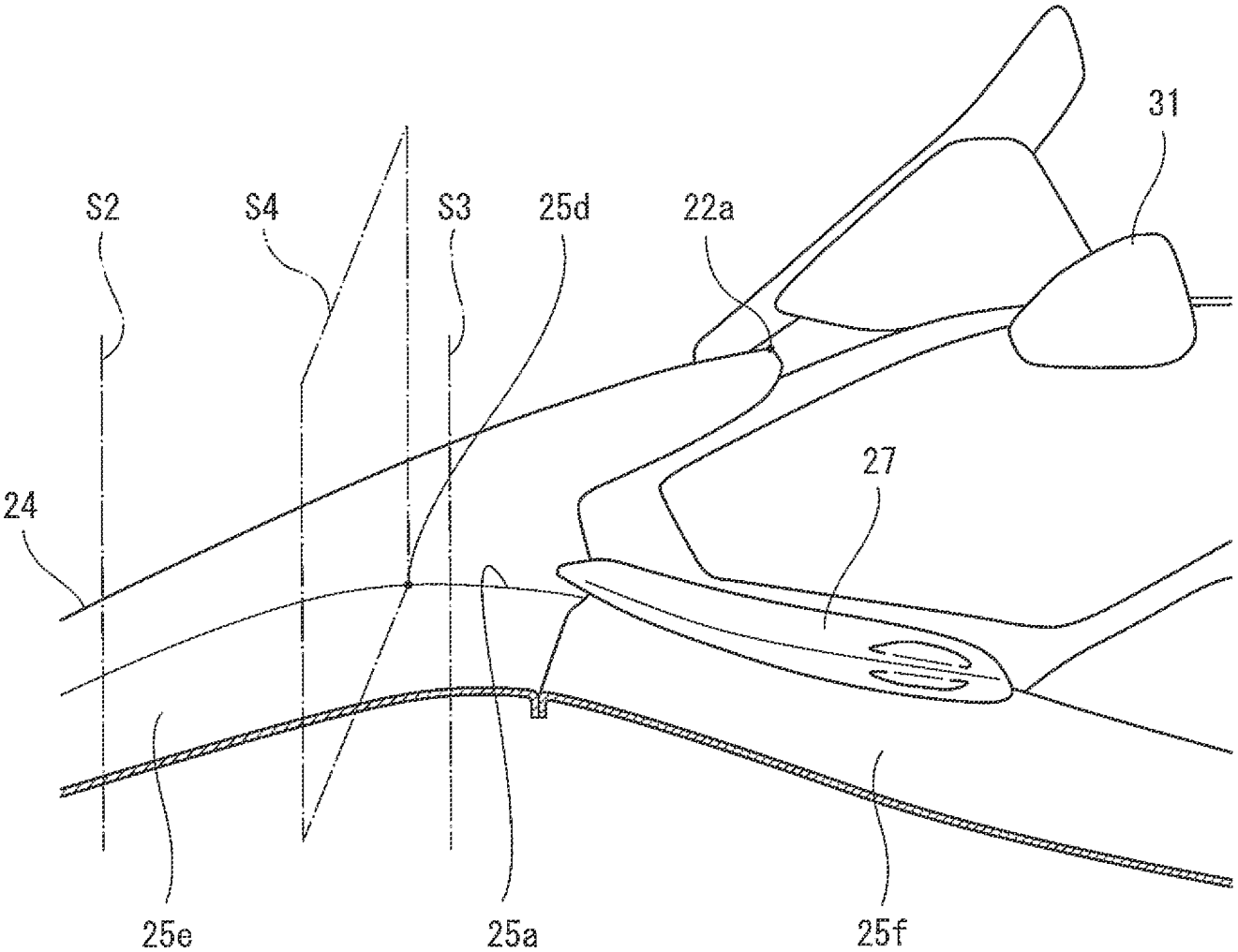
FIG. 4 is a cross-sectional view taken along the line L1 of FIG. 2.
Figure 5:
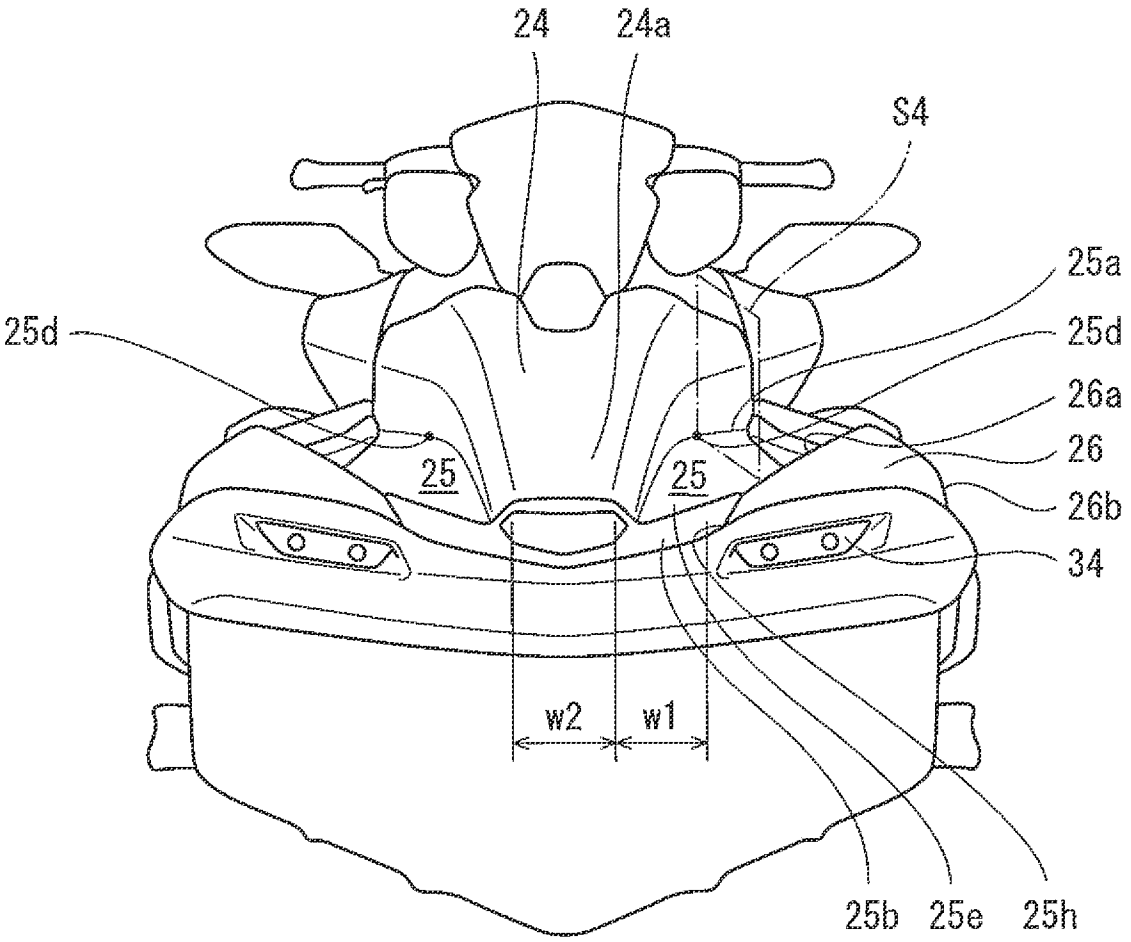
FIG. 5 is a front view of the personal watercraft of FIG. 1.

FIG. 2 is a front, right, top perspective view of the personal watercraft 1. FIG. 3A is a cross-sectional view of the watercraft body 2 taken along the plane S1 of FIG. 2 which is perpendicular to the front-rear direction. FIG. 3B is a cross-sectional view of the watercraft body 2 taken along the plane S2 of FIG. 2 which is perpendicular to the front-rear direction. FIG. 3C is a cross-sectional view of the watercraft body 2 taken along the plane S3 of FIG. 2 which is perpendicular to the front-rear direction. In FIG. 2, the planes S1, S2, and S3 are arranged in this order from the front of the watercraft body 2. FIGS. 3A, 3B, and 3C show the watercraft body 2 as viewed from the front. FIG. 4 is a cross-sectional view of the watercraft body 2 taken along the line L1 of FIG. 2 which extends along the flow path of a drainage channel 25. FIG. 4 shows the watercraft body 2 as viewed in the horizontal direction. FIG. 5 is a front view of the personal watercraft 1. As seen from FIG. 2, the front portion of the watercraft body 2 is formed such that its length in the left-right direction increases from front to rear. Thus, the watercraft body 2 has a streamlined shape when viewed in plan. The deck 4 includes a front upper portion 23 constituting a part of the front of the personal watercraft 1, and the front upper portion 23 is formed such that its height increases from front to rear. Specifically, the surface of the front upper portion 23 is curved in an upwardly convex shape such that the height of the surface increases from front to rear. In the present embodiment, the "front upper portion" 23 refers to a streamlined portion of that region of the watercraft body 2 which extends approximately from the front end of the watercraft body 2 to the steering shaft 20 in the front-rear direction, the portion being formed such that its height increases from front to rear. A center elongated protrusion 24 and a pair of drainage channels 25 are disposed in the front upper portion 23. The center elongated protrusion 24 and drainage channels 25 will be described in detail later. In the present embodiment, the center elongated protrusion 24 and the drainage channels 25 constitute a part of the front upper portion 23. Each drainage channel 25 is recessed downward and extends in the front-rear direction. A pair of outside elongated protrusions 26 are respectively located outward of and adjacent to the pair of drainage channels 25 in the left-right direction. Each outside elongated protrusion 26 protrudes upward with respect to a bottom surface 25*i* (FIGS. 3A to 3C) of the adjacent drainage channel 25 and extends in the front-rear direction of the watercraft body 2. A guide 27 is located on an extension of a boundary plane between each drainage channel 25 and the center elongated protrusion 24 in the watercraft body 2. The guide 27 lies along the drainage channel 25. A pair of side mirrors 31 are disposed between the handle 19 and the hatch cover 22 in the front-rear direction of the watercraft body 2. The rider can view the environment behind the watercraft with the aid of the side mirrors 31. A speaker 32 is disposed ahead of the guide 27. The rider can, for example, enjoy music by causing the speaker 32 to output the music.

The center elongated protrusion 24 is a part of the front upper portion 23 of the deck 4. The center elongated protrusion 24 is located at the center of the watercraft body 2 in the left-right direction and extends in the front-rear direction. In a front view of the watercraft body 2, the center elongated protrusion 24 has an upwardly convex cross-sectional shape over the entire length in the front-rear direction. The center elongated protrusion 24 includes an upper surface 24*a* located at the center thereof in the left-right direction, and the upper surface 24*a* extends in the front-rear direction in an inclined manner such that the height of the upper surface 24*a* increases from front to rear. The upper surface 24*a* of the center elongated protrusion 24 has opposite outer ends 24*b* in the left-right direction. The center elongated protrusion 24 includes side walls 24*c* extending downward from the outer ends 24*b* of the upper surface 24*a*. The side walls 24*c* are opposite each other in the left-right direction. The distance between the side walls 24*c* in the left-right direction increases from front to rear. The side walls 24*c* as viewed in plan are inclined with respect to the center line L2 (FIGS. 3A to 3C) dividing the watercraft body 2 in two in the left-right direction. Specifically, the left side wall 24*c* extends rearward and leftward, and the right side wall 24*c* extends rearward and rightward. The angle of inclination of each side wall 24*c* to the center line is larger in a rear region of the side wall 24*c* than in a front end region of the side wall 24*c*. Thus, the front portion of the side wall 24*c* faces outward in the left-right direction, and the rear portion of the side wall 24*c* faces outward in the left-right direction and forward. The center elongated protrusion 24 includes a connection portion 24*d* located between the upper surface 24*a* and each side wall 24*c*. The connection portion 24*d* is inclined downward toward the outside in the left-right direction. The angle of inclination of the connection portion 24*d* to the upper surface 24*a* is smaller than that of the side wall 24*c*. The center elongated protrusion 24 need not include the connection portions 24*d*, and the upper surface 24*a* may be directly adjacent to the side walls 24*c*.

The drainage channels 25 are outward of and adjacent to, respectively, the opposite sides of the center elongated protrusion 24 in the left-right direction. Each drainage channel 25 lies along the center elongated protrusion 24 in the front-rear direction, and extends rearward and outward in the left-right direction. In a plan view of the watercraft body 2, the drainage channel 25 is bent in a shape convex toward the inside of the watercraft body 2. The drainage channel 25 is a part of the front upper portion 23 of the deck 4. The flow path of the drainage channel 25 is surrounded on both sides in the left-right direction by the side wall 24*c* of the center elongated protrusion 24 and the outside elongated protrusion 26. In a front view of the watercraft body 2, the flow path of the drainage channel 25 has a downwardly convex cross-sectional shape over the entire length in the front-rear direction. The flow path allows water to flow therethrough. The bottom surface 25*i* (FIGS. 3A to 3C) of the drainage channel 25 is located below the upper surface 24*a* of the center elongated protrusion 24 to which the drainage channel 25 is adjacent in the left-right direction of the watercraft body 2.

The drainage channel 25 includes a front end 25*b*, a rear end 25*c*, and a peak point 25*d* located between the front and rear ends 25*b* and 25*c* and at the maximum height in the drainage channel 25. The region of the drainage channel 25 from the front end 25*b* to the peak point 25*d* is defined as a "front region 25*e*", and the front region 25*e* extends obliquely upward and rearward as seen from FIGS. 3A, 3B, and 4. The region of the drainage channel 25 from the peak point 25*d* to the rear end 25*c* is defined as a "rear region 25*f*". As seen from FIGS. 3C and 4, the rear region 25*f* extends obliquely downward and rearward. In the present embodiment, the front region 25*e* corresponds to the region of the drainage channel 25 that is anterior to an imaginary plane S4 perpendicular to the direction of water flow in the drainage channel 25 and passing through the peak point 25*d*, and the rear region 25*f* corresponds to the region that is posterior to the plane S4. The drainage channel 25 opens at the rear end 25*c* to the outside. Water entering the drainage channel 25 from the front end 25*b* is discharged outside through the rear end 25*c*. The drainage channel 25 includes an upper edge 25*a* which is not only an upper edge in the up-down direction of the watercraft body 2 but also an inner edge in the left-right direction of the watercraft body 2. Since the drainage channel 25 is inclined downward toward the outside in the left-right direction of the watercraft body 2, the inner edge of the drainage channel 25 in the left-right direction forms the upper edge 25*a* of the drainage channel 25. The upper edge 25*a* is inclined upward from the front end 25*b* to the peak point 25*d* so that the height of the upper edge 25*a* increases from front to rear. In the region posterior to the peak point 25*d*, the upper edge 25*a* extends outward in the left-right direction, and is inclined downward toward the outside in the left-right direction so that the height of the upper edge 25*a* decreases from inside to outside in the left-right direction.

As seen from FIGS. 3A and 3B, the flow path of the front region 25*e* of the drainage channel 25 is surrounded on both sides in the left-right direction by the side wall 24*c* of the center elongated protrusion 24 that is adjacent to the drainage channel 25 and an inner side wall 26*c* of the outside elongated protrusion 26 that is adjacent to the drainage channel 25. Thus, water entering the drainage channel 25 flows rearward in the front-rear direction while being surrounded on both sides in the left-right direction by the side wall 24*c* of the center elongated protrusion 24 and the side wall 26*c* of the outside elongated protrusion 26. In a cross-sectional view of the drainage channel 25 taken along a plane perpendicular to the front-rear direction of the watercraft body 2, the front region 25*e* of the drainage channel 25 has a downwardly convex cross-section defined by the side wall 24*c* of the center elongated protrusion 24, the bottom surface 25*i*, and the side wall 26*c* of the outside elongated protrusion 26. Thus, in the present embodiment, the cross-section of the drainage channel 25 taken along the plane perpendicular to the front-rear direction is defined by the two side walls and one bottom wall. As such, the cross-section of the drainage channel 25 taken along the plane perpendicular to the front-rear direction has a downwardly convex shape. The bottom surface 25*i* of the drainage channel 25 is located below the upper surface 24*a* of the center elongated protrusion 24 and the upper end of the outside elongated protrusion 26 over the entire length in the front-rear direction.

In the present embodiment, the side wall 24*c* of the center elongated protrusion 24 includes a vertically extending surface facing the drainage channel 25. The side wall 24*c* of the center elongated protrusion 24 includes a rear-side region located in the vicinity of the guide 27 and inclined inward from top to bottom.

In the present embodiment, the hatch cover 22 includes a part of the center elongated protrusion 24 and a part of each drainage channel 25. Specifically, the center elongated protrusion 24 and the front region of each drainage channel 25 are disposed in the upper surface of the hatch cover 22. In a cross-sectional view of the front region of the drainage channel 25 taken along a plane perpendicular to the flow path of the drainage channel 25, the side wall 24*c* of the center elongated protrusion 24 and the bottom surface 25*i* of the drainage channel 25 constitute a part of the hatch cover 22. The guide 27 is disposed in a part of the watercraft body 2 that is other than the hatch cover 22.

The drainage channel 25 includes an intermediate point 25*g* located substantially at the midpoint between the front end 25*b* and the rear end 25*c* in the front-rear direction of the watercraft body 2. The guide 27 extends between the intermediate point 25*g* and rear end 25*c* of the drainage channel 25 in the front-rear direction of the watercraft body 2.

In the present embodiment, a width w1 in the left-right direction of the front end 25*b* of the drainage channel 25 is greater than a width w2 in the left-right direction of a portion of the center elongated protrusion 24 that is at the same location as the front end 25*b* of the drainage channel 25 in the front-rear direction.

The rear region 25*f* of the drainage channel 25 is located in a different region than the hatch cover 22. In the present embodiment, the rear region 25*f* is located in a region of the upper surface of the deck 4 other than the region in which the hatch cover 22 is located. The boundary line between the drainage channel 25 and the center elongated protrusion 24 in the left-right direction extends in a curve rearward and outward in the left-right direction. As seen from FIG. 4, the drainage channel 25 extends to a region posterior to the center elongated protrusion 24.

The outside elongated protrusions 26 are located outward, respectively, of the left and right drainage channels 25 in the left-right direction. In a front view of the watercraft body 2, each outside elongated protrusion 26 has an upwardly convex cross-sectional shape over the entire length in the front-rear direction. In the present embodiment, the outside elongated protrusion 26 protrudes upward with respect to the bottom surface 25*i* of the drainage channel 25. The outside elongated protrusion 26 lies along the drainage channel 25 in the front-rear direction. The outside elongated protrusion 26 faces the drainage channel 25 from outside in the left-right direction.

Figure 6:
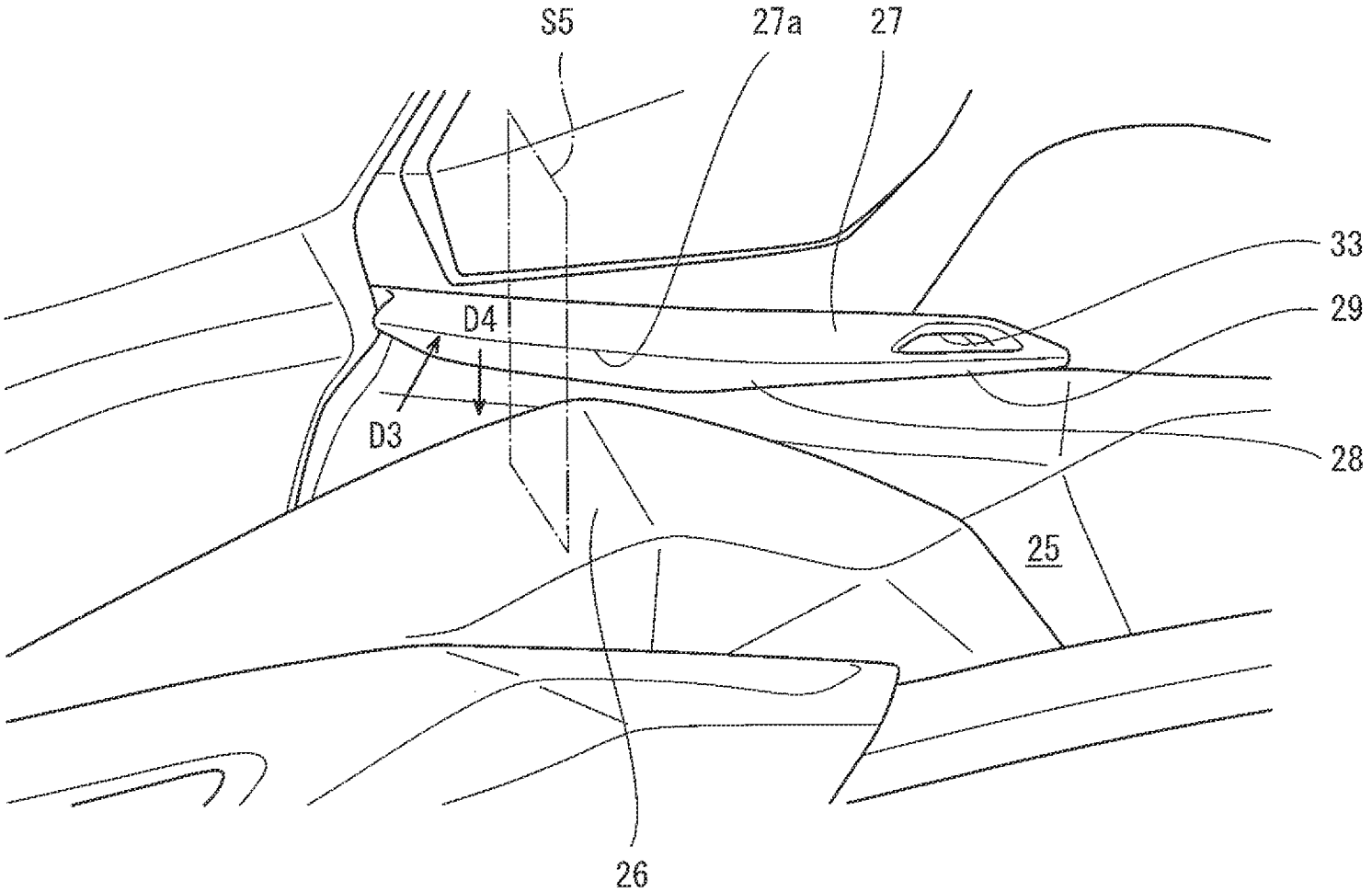
FIG. 6 is a perspective view showing a guide and its vicinity in the personal watercraft of FIG. 1.
Figure 7:
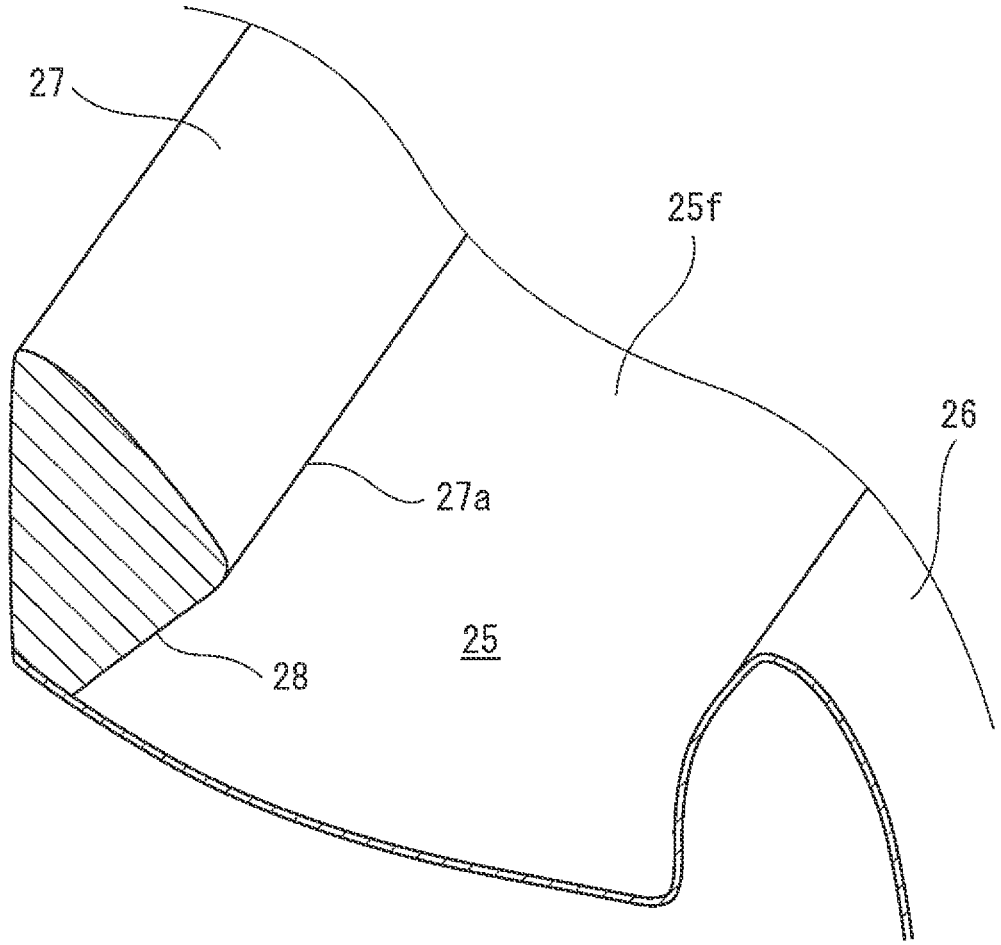
FIG. 7 is a cross-sectional view taken along the plane S5 of FIG. 6.

The guide 27 extends along the upper edge 25*a* of the drainage channel 25. The guide 27 protrudes upward from the upper edge 25*a*. In the region of the watercraft body 2 where the guide 27 is located, that portion of the drainage channel 25 which is at the same location as the guide 27 in the front-rear direction extends in a direction having a component corresponding to the left-right direction of the watercraft body 2. Thus, the guide 27 also extends in the direction having a component corresponding to the left-right direction of the watercraft body 2. In the present embodiment, the guide 27 extends rearward and outward in the left-right direction of the watercraft body 2. In the present embodiment, the guide 27 is located above the outside elongated protrusion 26 over the entire length in the front-rear direction. The guide 27 is located below the highest point of the hatch cover 22 over the entire length in the front-rear direction. The highest point of the hatch cover 22 is referred to as the "peak point 22*a*". As seen from FIG. 4, the entire guide 27 is located below the peak point 22*a*. FIG. 6 is an enlarged perspective view of the guide 27. FIG. 7 is a top perspective cross-sectional view of the drainage channel 25 taken along the plane S5 of FIG. 6. The guide 27 includes a guide surface 28 for guiding water flowing through the drainage channel 25.

In the present embodiment, the guide 27 is in the shape of a blade extending in the front-rear direction of the watercraft body 2. The guide 27 includes a blade-shaped central portion 27*a* protruding outward in the left-right direction of the watercraft body 2, in particular toward the drainage channel 25 (FIG. 7). That is, the guide 27 includes an overhang facing the drainage channel 25. In other words, the guide 27 as viewed in plan overlaps the bottom of the drainage channel 25. Since the central portion 27*a* of the guide 27 in the up-down direction protrudes toward the drainage channel 25, the guide surface 28 located below the central portion 27*a* faces downward. Thus, the guide surface 28 faces water flowing through the drainage channel 25 from above. Such a guide surface 28 can control the flow of water through the drainage channel 25 to prevent upward spattering of the water. The guide surface 28 extends rearward in a direction having a component directed outward in the left-right direction. Thus, when water is flowing through the drainage channel 25 in the front-rear direction, the guide surface 28 acts on the flowing water downwardly in the up-down direction and outwardly in the left-right direction. In the present embodiment, the guidance of the water flow in the drainage channel 25 by the guide 27 is effected at a location posterior to the center elongated protrusion 24 in the front-rear direction.

The guide 27 includes a lock 29 configured to lock a string-like element such as a rope. In the present embodiment, the guide 27 is provided with a hole 33 extending through the guide 27 in the up-down direction. Thus, for example, the watercraft body 2 can be moored by locking one end of the string-like element such as a rope to the guide 27 and winding the other end of the string-like element around a support such as a pole which is situated on the land. For example, a hooking device such as a karabiner may be attached to one end of the string-like element, and the string-like element may be locked to the lock 29 by means of the hooking device.

The guide 27 is located over the rear region 25*f* of the drainage channel 25. Thus, the guide 27 is located downstream of the peak point 25*d* of the drainage channel 25.

The watercraft body 2 includes foot rest surfaces 30 located on the opposite sides of the seat 5 in the left-right direction. The rear end 25*c* of the rear region 25*f* of the drainage channel 25 is located outward of the foot rest surface 30 in the left-right direction.

In the present embodiment, the outer end 26*b* of the outside elongated protrusion 26 in the left-right direction extends rearward and outward in the left-right direction. The outer end 24*b* of the upper surface 24*a* of the center elongated protrusion 24 in the left-right direction is located above a ridge line 26*a* of the outside elongated protrusion 26 when the outer end 24*b* and the ridge line 26*a* are compared at the same location in the front-rear direction. The "ridge line" 26*a* refers to a line drawn through peak points of the outside elongated protrusion 26, and a "peak point" of the outside elongated protrusion 26 refers to the highest point of the outside elongated protrusion 26 at a location in the front-rear direction. In the present embodiment, the bottom surface 25*i* of the drainage channel 25 is located below an imaginary line drawn between any peak point of the outside elongated protrusion 26 and the upper surface 24*a* of the center elongated protrusion 24.

In the present embodiment, when the outside elongated protrusion 26 is viewed from the side, the portion of the ridge line 26*a* that is anterior to the guide 27 is inclined upward from front to rear, and the portion of the ridge line 26*a* that extends over the same region as the guide 27 in the front-rear direction is inclined downward from front to rear (FIG. 1). Further, the front end portion of the outside elongated protrusion 26 is shaped to conform to the tapered shape of the watercraft body 2. Specifically, the front end portion of the outside elongated protrusion 26 is shaped to extend obliquely rearward and outward in the left-right direction.

A light 34 is disposed in the vicinity of the front end of the watercraft body 2 to emit light forward from the watercraft body 2. In the present embodiment, the light 34 emits light from the location of the front end of the outside elongated protrusion 26. In the present embodiment, the light 34 and an element for allowing the light 34 to emit light (e.g., a driving circuit) are placed within the outside elongated protrusion 26.

When the personal watercraft 1 configured as described above is moving straight on a water surface, water impinges on the front of the watercraft body 2 in the direction D1 (FIGS. 1 and 2) and flows rearward along the watercraft body 2. In the present embodiment, impinging water located relatively inward and close to the center of the watercraft body 2 in the left-right direction flows into the drainage channel 25. Specifically, water impinging on a front region of the watercraft body 2 that is inward of the outer end 25*h* of the drainage channel 25 in the left-right direction is led into the drainage channel 25. Most of water impinging on the center elongated protrusion 24 is directed outward in the left-right direction along the center elongated protrusion 24 which extends rearward and outward in the left-right direction, and the water thus directed enters the drainage channel 25.

Since the drainage channel 25 extends rearward and outward in the left-right direction, water impinging on the front of the watercraft body 2 and entering the drainage channel 25 can be directed outward in the left-right direction and thus discharged outside. Most of the water entering the drainage channel 25 flows rearward through an inner region in the left-right direction of the drainage channel 25. Since the inner end of the drainage channel 25 in the left-right direction extends rearward and outward in the left-right direction, most of the water entering the drainage channel 25 can be directed outward in the left-right direction and thus discharged outside. As such, the water flowing in the drainage channel 25 can be prevented from moving toward the rider. This can reduce the amount of water splashing onto the rider and therefore the discomfort felt by the rider due to splashing water. Additionally, the water entering the drainage channel 25 can be efficiently guided and discharged outside since the flow path of the drainage channel 25 is surrounded on both sides in the left-right direction by the side wall 24*c* of the center elongated protrusion 24 and the side wall 26*c* of the outside elongated protrusion 26 and since the flow path has a cross-sectional shape convex downward when viewed from the front and convex toward the center of the watercraft body 2 in the left-right direction. The water flowing in the drainage channel 25 is guided by the side wall 26*c* of the outside elongated protrusion 26 to flow rearward in the front-rear direction without flowing outward from the drainage channel 25 in the left-right direction, and redirected outward in the left-right direction by the center elongated protrusion 24 and the guide 27.

Water impinging on a front region of the watercraft body 2 that is outward of the outer end 25*h* of the drainage channel 25 in the left-right direction collides with the outside elongated protrusion 26. The water colliding with the outside elongated protrusion 26 flows along the outside elongated protrusion 26 and is directed outward in the left-right direction since the outer end 26*b* of the outside elongated protrusion 26 in the left-right direction extends rearward and outward in the left-right direction. Thus, water colliding with the outside elongated protrusion 26 without entering the drainage channel 25 can be made to flow outward in the left-right direction along the outer end 26*b* of the outside elongated protrusion 26. This can reduce the amount of water moving toward the rider.

In the present embodiment, the watercraft body 2 includes the outside elongated protrusion 26 outward of and adjacent to the drainage channel 25 in the left-right direction. Thus, for example, when the personal watercraft 1 is turning, water impinging obliquely on the front of the watercraft body 2 and moving toward the rider can be blocked by the outside elongated protrusion 26. The personal watercraft 1 is usually decelerated when making a turn. Upon deceleration of the personal watercraft 1, a moment acts on the watercraft body 2 in the pitch direction, causing the front end of the watercraft body 2 to sink downward. Thus, during turning of the personal watercraft 1, water impinging obliquely on the front of the personal watercraft 1 could climb over the front end portion of the personal watercraft 1 toward the rider, and the rider could be splashed with a lot of water. However, in the present embodiment, where the watercraft body 2 includes the outside elongated protrusion 26 outward of the drainage channel 25 in the left-right direction, water impinging obliquely on the front of the personal watercraft 1 can be blocked by the outside elongated protrusion 26. During turning, since the front end portion of the watercraft body 2 sinks downward, water is more likely to reach the rider beyond the watercraft body 2 than in other situations. In the present embodiment, where the outside elongated protrusion 26 has an upwardly convex cross-sectional shape over the entire length in the front-rear direction in a front view of the watercraft body 2, water impinging on the watercraft body 2 can be prevented from climbing over the outside elongated protrusion 26. This can reduce the amount of water splashing onto the rider. Even if water climbs over the outside elongated protrusion 26, the water can be blocked by the center elongated protrusion 24. In particular, since the side wall 24*c* of the center elongated protrusion 24 includes a portion inclined inward from top to bottom, part of water climbing over the outside elongated protrusion 26 collides with that inclined portion of the side wall 24*c* and is thus redirected downward. As such, water having passed beyond the outside elongated protrusion 26 can be prevented from climbing over the center elongated protrusion 24.

In the present embodiment, where the rear region 25*f* of the drainage channel 25 extends obliquely downward and rearward, water entering the drainage channel 25 when the personal watercraft 1 is moving at a relatively low speed (10 to 30 km/h, for example) is made to flow downward through the drainage channel 25 and discharged outside in a direction as indicated by the arrow D2 of FIG. 2. That is, the water is discharged outside through the drainage channel 25 in an obliquely downward direction. Thus, water is not likely to splash upward out of the drainage channel 25 during movement of the personal watercraft 1. This can reduce the amount of water splashing onto the rider and therefore the discomfort felt by the rider due to splashing water.

In the present embodiment, where the rear end 25*c* of the drainage channel 25 is outward of the foot rest surface 30 in the left-right direction, water flowing in the drainage channel 25 can be prevented from moving toward the foot rest surface 30. This can reduce the amount of water retained on the foot rest surface 30 and therefore the discomfort felt by the rider due to retained water.

In the present embodiment, the width w1 in the left-right direction of the front end 25*b* of the drainage channel 25 is greater than the width w2 in the left-right direction of the portion of the center elongated protrusion 24 that is at the same location as the front end 25*b* of the drainage channel 25 in the front-rear direction. Thus, water imping on the front of the watercraft body is likely to enter the drainage channel 25. As such, much of the impinging water can be made to flow outward in the left-right direction through the drainage channel 25, so that the amount of water moving toward the rider can be reduced.

In the present embodiment, the outer end 24*b* of the upper surface 24*a* of the center elongated protrusion 24 is located above the ridge line 26*a* of the outside elongated protrusion 26 when the outer end 24*b* and the ridge line 26*a* are compared at the same location in the front-rear direction. Thus, water climbing over the outside elongated protrusion 26 during turning of the personal watercraft 1 can be blocked by the center elongated protrusion 24. This can further reduce the amount of water moving toward the rider.

In the present embodiment, the personal watercraft 1 includes the guide 27 including the guide surface 28 facing the drainage channel 25 from above. Thus, for example, when a large amount of water flows in the drainage channel 25 and some of the water climes over the drainage channel 25 toward the rider, the guide surface 28 pushes down the water from above. For example, when water climbs over the drainage channel 25 in a direction as indicated by the arrow D3 of FIG. 6, the water is pushed back by the guide surface 28 and then flows in a direction as indicated by the arrow D4. When the personal watercraft 1 is moving at a relatively high speed and water is flowing swiftly in that front region 25*e* of the drainage channel 25 which is inclined upward from front to rear, the water could jump upward by inertia above the rear region 25*f*. Also in this case, the guide surface 28 pushes down the splashing water from above and prevents the water from moving toward the rider. Thus, water flowing in the drainage channel 25 can be prevented from moving toward the rider. This can reduce the discomfort felt by the rider due to splashing water.

In the present embodiment, where the guide 27 is located over the rear region 25*f* of the drainage channel 25, the guide surface 28 can push down water passing through the peak point 25*d* of the drainage channel 25 and flowing in the downwardly and rearwardly extending portion of the drainage channel 25. This further ensures that water flowing in the drainage channel 25 is prevented from moving toward the rider.

In the present embodiment, where the guide 27 is disposed in a part other than the hatch cover 22, the need to form the hatch cover 22 in a complicated shape is eliminated. This can result in reduced manufacturing cost of the watercraft body 2.

In the present embodiment, the guide 27 is produced in a different manufacturing step than the deck 4. In the present embodiment, the deck 4 is made of resin and formed by one-piece molding. If the guide 27, which has the central portion 27*a* located at the center of the guide 27 in the up-down direction and protruding toward the drainage channel 25, were produced together with the deck 4, mold release would be so difficult that the manufacturing process would be complicated. In the present embodiment, the guide 27 is made of resin and formed by one-piece molding in a different manufacturing step than the deck 4, and the guide 27 thus formed is attached to the deck 4. As such, the deck 4 provided with the guide 27 can easily be produced.

In the present embodiment, the guide surface 28 extends in a direction having a component corresponding to the left-right direction. Such a guide surface 28 can, when water is flowing in the drainage channel 25, efficiently guide the water outward in the left-right direction. This can prevent water from flowing upward out of the drainage channel 25, further ensuring that the water is prevented from moving toward the rider.

In the present embodiment, the guide 27 extends between the intermediate point 25*g* and rear end 25*c* of the drainage channel 25. Thus, the guide 27 can reliably guide water toward the outside in the region of the drainage channel 25 from the intermediate point 25*g* to the rear end 25*c*. This can reliably prevent water from flowing upward out of the drainage channel 25 and moving toward the rider in the region of the drainage channel 25 from the intermediate point 25*g* to the rear end 25*c*.

In the present embodiment, the boundary line between the drainage channel 25 and the center elongated protrusion 24 in the left-right direction (in particular, the upper edge 25*a* of the drainage channel 25) extends rearward and outward in the left-right direction. Thus, most of water flowing in the drainage channel 25 can be efficiently guided outward in the left-right direction. In the present embodiment, the amount of water flowing in the drainage channel 25 is larger in the vicinity of the boundary line between the drainage channel 25 and the center elongated protrusion 24 than in other regions of the inside of the drainage channel 25. When the personal watercraft 1 is moving straight, water flowing on the upper surface of the watercraft body 2 tends to move straight from the front of the watercraft body 2 in the front-rear direction of the watercraft body 2. Thus, water entering the drainage channel 25 tends to flow straight rearward in the front-rear direction of the watercraft body 2. Water entering the inner region of the drainage channel 25 in the left-right direction tends to move straight rearward along the center elongated protrusion 24, while water entering the outer region of the drainage channel 25, which also tends to move straight rearward, comes into the inner region of the drainage channel 25 with the progress of the rearward flow since the drainage channel 25 is shaped to extend rearward and outward in the left-right direction. Consequently, water flowing in the drainage channel 25 is gathered inward in the left-right direction of the watercraft body 2 with the progress of the rearward flow. Thus, the amount of water flowing in the drainage channel 25 is larger in the inner region of the drainage channel 25 (including the region lying along the side wall 24*c* of the center elongated protrusion 24) in the left-right direction than in the outer region of the drainage channel 25 in the left-right direction.

Since the amount of water flowing in the drainage channel 25 is larger in the vicinity of the boundary line between the drainage channel 25 and the center elongated protrusion 24 than in other regions of the inside of the drainage channel 25, the amount of water directed outward in the left-right direction can be increased by shaping the boundary line so that the boundary line extends rearward and outward in the left-right direction. In the present embodiment, the boundary line between the drainage channel 25 and the center elongated protrusion 24 in the left-right direction extends in a curve. Thus, the direction of water flowing in the drainage channel 25 can be gradually changed with the progress of the rearward flow to prevent the water from overflowing out of the drainage channel 25.

In the present embodiment, where the guide 27 includes the lock 29, the watercraft body 2 need not include any additional element for locking of the string-like element. This can reduce the number of parts constituting the watercraft body 2.

In the present embodiment, where a part of the center elongated protrusion 24 and a part of the drainage channel 25 are constituted by the hatch cover 22, the center elongated protrusion 24 and the drainage channel 25 can easily be formed. In particular, in the present embodiment, a part of the center elongated protrusion 24 and a part of the front region 25*e* of the drainage channel 25 are disposed in the upper surface of the hatch cover 22. Thus, the formation of the center elongated protrusion 24 and the front region 25*e* of the drainage channel 25 can easily be accomplished.

In the present embodiment, where the outside elongated protrusion 26 of the personal watercraft 1 is provided with the light 34, the personal watercraft 1 can inform the outside world of its presence. Since the light 34 is disposed in the outside elongated protrusion 26, the light 34 and an element for allowing the light 34 to emit light (e.g., a driving circuit) can be placed within the outside elongated protrusion 26. Thus, the available space of the watercraft body 2 can be efficiently used to prevent size increase of the personal watercraft 1.

While in the embodiment described above the center elongated protrusion 24 is higher than the outside elongated protrusion 26, this configuration is not limiting. The outside elongated protrusion 26 may be higher than the center elongated protrusion 24.

In the embodiment described above, the front end of the drainage channel 25 is wider in the left-right direction than a portion of the center elongated protrusion 24 that is at the same location as the front end of the drainage channel 25 in the front-rear direction. However, this configuration is not limiting. The front end of the center elongated protrusion 24 may be wider in the left-right direction than the front end of the drainage channel 25.

While in the embodiment described above the watercraft body 2 includes the guide 27, this configuration is not limiting. The watercraft body 2 need not include the guide 27 insofar as the watercraft body 2 includes the center elongated protrusion 24, drainage channel 25, and outside elongated protrusion 26 and water impinging on the watercraft body 2 can be discharged outside without moving toward the rider.

While in the embodiment described above the watercraft body 2 includes the outside elongated protrusion 26, this configuration is not limiting. The watercraft body 2 need not include the outside elongated protrusion 26 insofar as the watercraft body 2 includes the center elongated protrusion 24, drainage channel 25, and guide 27 and water impinging on the watercraft body 2 can be discharged outside without moving toward the rider.

While in the embodiment described above, the personal watercraft 1 is equipped with the light 34, this configuration is not limiting. The personal watercraft 1 need not be equipped with the light 34. While in the embodiment described above the outside elongated protrusion 26 of the personal watercraft 1 is equipped with the light 34, this configuration is not limiting either. The light may be disposed in a part other than the outside elongated protrusion 26. The light may be arranged to emit light in a direction other than the forward direction, and may be disposed at any location in the personal watercraft 1.

What is claimed is:

1. A personal watercraft comprising:

a handle; and a watercraft body supporting the handle and including a front upper portion anterior to the handle, the watercraft body further including:

a center elongated protrusion constituting a part of the front upper portion, the center elongated protrusion being located at a center of the watercraft body in a left-right direction, extending in a front-rear direction, and having an upwardly convex cross-sectional shape;

a drainage channel constituting a part of the front upper portion, the drainage channel being outward of and adjacent to the center elongated protrusion in the left-right direction, lying along the center elongated protrusion in the front-rear direction, extending rearward and outward in the left-right direction, and having a downwardly convex cross-sectional shape; and an outside elongated protrusion outward of and adjacent to the drainage channel in the left-right direction, the outside elongated protrusion lying along the drainage channel in the front-rear direction, having an upwardly convex cross-sectional shape, and facing the drainage channel from outside in the left-right direction, wherein the drainage channel guides water entering the drainage channel to discharge the water outside the personal watercraft in the left-right direction.

2. The personal watercraft according to claim 1, wherein the drainage channel includes a front end, a rear end, and a peak point located between the front end and the rear end, a front region of the drainage channel from the front end to the peak point extends obliquely upward and rearward, and a rear region of the drainage channel from the peak point to the rear end extends obliquely downward and rearward.

3. The personal watercraft according to claim 1, further comprising a seat posterior to the handle, wherein the watercraft body further includes a foot rest surface outward of the seat in the left-right direction, and a rear end of the drainage channel is anterior to the foot rest surface.

4. The personal watercraft according to claim 1, wherein a front end of the drainage channel is wider in the left-right direction than a portion of the center elongated protrusion, the portion of the center elongated protrusion being at the same location as the front end of the drainage channel in the front-rear direction.

5. The personal watercraft according to claim 1, wherein an outer end of an upper surface of the center elongated protrusion in the left-right direction is located above a ridge line of the outside elongated protrusion when the outer end and the ridge line are compared at the same location in the front-rear direction, the ridge line being a line drawn through peak points of the outside elongated protrusion, each of the peak points being the highest point of the outside elongated protrusion at a location in the front-rear direction.

6. The personal watercraft according to claim 1, wherein the watercraft body further includes a guide protruding from an upper edge of the drainage channel and including a guide surface, the guide surface extending along the upper edge and facing the drainage channel from above, the drainage channel includes a front end, a rear end, and a peak point located between the front end and the rear end, and the guide lies along the upper edge in a rear region of the drainage channel from the peak point to the rear end and is inclined to extend rearward and outward in the left-right direction.

7. The personal watercraft according to claim 6, wherein the watercraft body includes a hull, a deck covering the hull from above and having an upwardly facing opening, and a hatch cover closing the upwardly facing opening from above, and the guide is located outward of the hatch cover of the watercraft body in the left-right direction.

8. The personal watercraft according to claim 6, wherein the guide surface extends rearward in a direction having a component directed outward in the left-right direction.

9. The personal watercraft according to claim 1, wherein a boundary line between the drainage channel and the center elongated protrusion in the left-right direction extends in a curve rearward and outward in the left-right direction.

10. A personal watercraft, comprising:

a handle; and a watercraft body supporting the handle and including a front upper portion anterior to the handle, the watercraft body further including:

a drainage channel constituting a part of the front upper portion and having a downwardly convex cross-sectional shape, and a guide that pushes down water flowing through the drainage channel, wherein the guide includes a lock configured to lock a string-shaped element.

11. The personal watercraft according to claim 1, wherein the watercraft body includes a hull, a deck covering the hull from above and having an upwardly facing opening, and a hatch cover closing the upwardly facing opening from above, and the hatch cover includes a part of the center elongated protrusion and a part of the drainage channel.

12. The personal watercraft according to claim 11, wherein the drainage channel includes a front end, a rear end, and a peak point located between the front end and the rear end, the center elongated protrusion and a front region of the drainage channel from the front end to the peak point are disposed in an upper surface of the hatch cover, and a rear region of the drainage channel from the peak point to the rear end is disposed in an upper surface of the deck.

13. The personal watercraft according to claim 1, wherein a light is disposed in the outside elongated protrusion to emit light forward from the watercraft body.

14. The personal watercraft according to claim 1, wherein an outer end of the outside elongated protrusion in the left-right direction extends rearward and outward in the left-right direction.

15. The personal watercraft according to claim 2, wherein the rear end of the drainage channel opens outside the personal watercraft in the left-right direction.

16. The personal watercraft according to claim 1, wherein the drainage channel includes a front end, a rear end, and a peak point located between the front end and the rear end, and a rear region of the drainage channel from the peak point to the rear end is inclined to extend rearward and outward in the left-right direction.

17. A personal watercraft comprising:

a handle; and a watercraft body supporting the handle and including a front upper portion anterior to the handle, the watercraft body further including:

a center elongated protrusion constituting a part of the front upper portion, the center elongated protrusion being located at a center of the watercraft body in a left-right direction, extending in a front-rear direction, and having an upwardly convex cross-sectional shape;

a drainage channel constituting a part of the front upper portion, the drainage channel being outward of and adjacent to the center elongated protrusion in the left-right direction, lying along the center elongated protrusion in the front-rear direction, extending rearward and outward in the left-right direction, and having a downwardly convex cross-sectional shape; and an outside elongated protrusion outward of and adjacent to the drainage channel in the left-right direction, the outside elongated protrusion lying along the drainage channel in the front-rear direction, having an upwardly convex cross-sectional shape, and facing the drainage channel from outside in the left-right direction, wherein the drainage channel includes a front end opening forward.

* * * * *